US005891832A

United States Patent [19]

Rayborn, Sr. et al.

[11] Patent Number: 5,891,832

[45] Date of Patent: Apr. 6, 1999

[54] DRILLING FLUID ADDITIVE CONTAINING A FISH OIL/GLYCOL MIXTURE AND RELATED METHODS

[75] Inventors: Jerry J. Rayborn, Sr.; John J. Rayborn, both of Franklinton, La.

[73] Assignee: Sun Drilling Products Corp., Belle Chasse, La.

[21] Appl. No.: 986,779

[22] Filed: Dec. 8, 1997

[51] Int. Cl.[6] ..... C10M 129/16; C10M 129/68

[52] U.S. Cl. ..... 508/491; 508/501; 508/579; 507/136; 507/138; 507/139; 507/261; 507/265; 507/266; 507/904; 507/905

[58] Field of Search ..... 508/486, 489, 508/491, 501, 579; 507/136, 138, 139, 261, 265, 266, 904, 905

[56] References Cited

U.S. PATENT DOCUMENTS

| | | | |
|---|---|---|---|
| 2,793,996 | 5/1957 | Lummus | 507/138 |
| 3,065,172 | 11/1962 | Groves, Jr. et al. | 507/138 |
| 3,652,414 | 3/1972 | Bergeron . | |
| 3,652,415 | 3/1972 | Bergeron . | |
| 3,700,050 | 10/1972 | Miles | 175/65 |
| 3,883,439 | 5/1975 | Bergeron . | |
| 4,036,769 | 7/1977 | Zipf . | |
| 4,083,790 | 4/1978 | Grodde et al. | 507/138 |
| 4,175,047 | 11/1979 | Schick et al. | 508/501 |
| 4,356,096 | 10/1982 | Cowan et al. | 507/138 |
| 4,719,021 | 1/1988 | Branch, III | 507/136 |
| 5,478,385 | 12/1995 | Washbourne . | |
| 5,580,482 | 12/1996 | Chassan et al. . | |
| 5,586,608 | 12/1996 | Clark et al. | 507/136 |
| 5,658,860 | 8/1997 | Clark et al. | 507/134 |
| 5,707,940 | 1/1998 | Bush et al. | 507/138 |

FOREIGN PATENT DOCUMENTS

| | | |
|---|---|---|
| 3419415 A | 10/1985 | Germany . |
| 1738820 A1 | 7/1992 | U.S.S.R. . |

OTHER PUBLICATIONS

Garrett, Robert L., *How about fish oil in your mud?*, Drilling and Completion Fluids, Nov., 1993.

Bimbo, Anthony P., *The Emerging Oil Industry.*, Journal of the American Oil Chemists Society, pp. 706–716, vol. 64/No. 5, May, 1987.

Bimbo, Anthony P. and Jane B. Crowther, *Marine oils: fishing for industrial uses.*, Inform, pp. 988–1001, vol. 3, No. 9, Sep., 1992.

*Primary Examiner*—Margaret Medley
*Attorney, Agent, or Firm*—Dan M. de la Rosa

[57] ABSTRACT

A drilling fluid additive for use during drilling and excavating applications, the additive comprises a mixture of an oil, an ester alcohol, nonionic surfactant and polypropylene glycol; and a method for manufacturing a drilling fluid additive comprising the step of admixing an oil, an ester alcohol, a nonionic surfactant, and a polypropylene glycol.

16 Claims, 2 Drawing Sheets

DRILLING FLUID ADDITIVE CONTAINING A FISH OIL/GLYCOL MIXTURE AND RELATED METHODS

FIELD OF THE INVENTION

The present invention relates to a drilling fluid additive which provides enhanced lubricating and shale inhibiting qualities, enhanced fluid loss properties, improved wall cake thickness, improved bore hole stability, and a significant reduction in the adhesion of cuttings to the drill string.

BACKGROUND OF THE INVENTION

Oil and gas wells can be drilled more efficiently and economically if downtime is minimized and hole and drill string problems are eliminated.

Drilling fluids or muds are commonly used in the drilling of oil and gas wells provide numerous functions including: (1) cooling the drill bit; (2) lubricating the drill string; (3) cleaning the bore hole; (4) bringing the cuttings to the surface; (5) preventing the cavings of the formations by providing hole stability; (6) controlling fluid loss into the formations; and (7) exerting pressure to the sides of the bore hole to prevent the entrance of liquids or gases into the bore hole from the formation being penetrated.

The drilling fluid additive must have a low fluid loss to prevent excessive loss of fluid into the formation by depositing an impervious filter cake on the sides of the bore hole. The thickness of the filter cake is usually directly proportional to the volume of fluid loss. Therefore, the lower the fluid loss, the thinner the filter cake. Maintaining the diameter of the bore hole being drilled is critical to a successful operation. If the fluid loss is high, then the wall cake will be thick and therefore increasing the chance of sticking of the drill string.

Fluid loss additives most commonly used to control the fluid loss and also the wall cake thickness are bentonite clays, polymers, lignites, and surfactants.

Marine or fish oil is a versatile product and finds many applications in the food, feed and technical industries of the world. Like other fats and oils, fish oils consist of a mixture of triglycerides of various long-chain fatty acids with small amounts of mono- and diglycerides, free fatty acids and sterols. The fatty acids that characterize fish oils are similar to those in various vegetable oils and animal fats differing principally in their high proportions of long-chain polyunsaturated fatty acids with five and six double bonds. Marine oils differ among themselves in the percentage of fatty acids.

Although the use of fish oil in drilling/completion fluids has been contemplated, there have been no teachings of how fish oils can be incorporated into drilling fluid with improved results. An article entitled "How about fish oil in your mud"? by Robert Garrett was published in *Drilling & Completion Fluids*, November 1993 and discussed the need for biodegradable, low-toxicity and earth-friendly materials. However, the article did not discuss how fish oils could be implemented into a drilling fluid.

SUMMARY OF THE INVENTION

Accordingly, one object of the present invention is to provide a drilling fluid additive that allows gas and oil well drilling to become more efficient and economical.

Another object of the present invention is to provide a drilling fluid additive that has excellent mud lubricity; minimizes shale hydration; and provides for cleaner drill strings, lower fluid loss and thinner filter cake.

A further object of the present invention is to provide a drilling fluid additive that has improved properties as a lubricant and/or a shale inhibitor during drilling applications.

The present invention accordingly provides a drilling fluid additive comprising a mixture of a nonionic surfactant, an oil, an ester alcohol and a polypropylene glycol (PPG).

In one embodiment of the invention, the drilling fluid additive comprises a mixture of polyether polyol-poly (oxyethylene-oxy) propylene glycol, fish oil, 2,2,4 trimethyl-1,3 pentanediol monoisobutyrate and polypropylene glycol. The fish oil is preferably a refined menhaden fish oil (menhaden fish are also known as pogie).

In a further embodiment, the nonionic surfactant of the drilling fluid additive is a polyethoxylated glycol. The polyethoxylated glycol can be selected from a group consisting of polybutylene glycol, polyethylene glycol, polypropylene glycol and mixtures thereof. The oil in the additive can be selected from a group consisting of animal oil, mineral oil, vegetable oil, synthetic oil, and mixtures thereof. The ester alcohol can be an alcohol having a formula of $C_1$–$C_{16}$ with straight and/or branched chains.

The present invention also provides a drilling fluid additive comprising a nonionic surfactant. The surfactant can be a polyethoxylated glycol such as polyether polyol-poly (oxyethylene-oxy) propylene glycol. In one embodiment, the drilling fluid additive can comprise a polyethoyxlated glycol and a polypropylene glycol. In another embodiment of the invention, the drilling fluid additive can comprise a polyethoxylated glycol and an oil, such as a fish oil. The preferred fish oil is a refined menhaden fish oil.

The present invention also provides a drilling fluid additive comprising an oil. The oil is preferably a refined oil. Crude oil contains approximately 25% to 30% of solid stearine. Stearine reacts with the potassium hydroxide and sodium hydroxide in a well bore and causes foaming. The refined oil contains 0% stearine and thus, functions better as a drilling fluid additive. The oil can be refined in numerous procedures. A preferred method would be to chill the oil and filter out the solids containing the stearine. Thus, preferred oil for this embodiment is a refined menhaden fish oil. The refined oil for the drilling fluid additive can be an oil selected from a group consisting of animal oil, vegetable oil, mineral oil, synthetic oil, and mixture thereof. This drilling fluid additive can be used as a lubricant and/or a shale inhibitor.

In another embodiment, the drilling fluid additive can be comprised of an oil and an ester alcohol. The preferred oil is a refined menhaden fish oil and the preferred ester alcohol is 2,2,4 trimethyl-1,3 pentanediol monoisobutyrate.

In a further embodiment, the drilling fluid additive comprises an oil, an ester alcohol and nonionic surfactant. The preferred oil is a refined menhaden fish oil, the preferred ester alcohol is 2,2,4 trimethyl-1,3 pentanediol monoisobutyrate, and the preferred nonionic surfactant is polyether polyolpoly (oxyethylene-oxy) propylene glycol.

The present invention also provides a method for the manufacture of a drilling fluid additive. The method comprises the step of admixing an oil, an ester alcohol, a nonionic surfactant, and polypropylene glycol. In one embodiment, the oil and ester alcohol are first mixed together, then a nonionic surfactant is admixed and finally the polypropylene glycol is admixed to form the additive. In yet another embodiment, the oil is first mixed with an nonionic surfactant and then the ester alcohol is admixed and finally the propylene glycol is admixed.

The present invention also provides other methods for manufacturing a drilling fluid additive. In one embodiment, the method comprises providing a nonionic surfactant. In another embodiment, the surfactant is admixed with polypropylene glycol to make a drilling fluid additive. In a further embodiment, the surfactant is admixed with an oil, preferably a refined oil.

The presently claimed invention also provides a method of manufacturing which comprises providing an oil. In one embodiment, the oil is admixed with polypropylene glycol. In another embodiment, the oil is simply admixed with an ester alcohol. And in still another embodiment, the oil is admixed with an ester alcohol and an nonionic surfactant.

Many of the present invention's attributes as an effective lubricant, a fluid loss reducer and shale hydration inhibitor is due to the combination of fish oil/glycol added to a water based drilling system. The fish oil/glycol combination provides (1) excellent mud lubricity, (2) cleaner drill string by preferential wetting of metal surfaces, (3) lower fluid loss, (4) thinner filter cake, and (5) minimization of shale hydration.

BRIEF DESCRIPTION OF THE DRAWINGS

A more complete appreciation of the present invention and many of the attendant advantages thereof will be readily understood by reference to the following description when considered in connection with the accompanying drawings in which.

DETAILED DESCRIPTION OF THE PRESENT INVENTION

Figure 1:
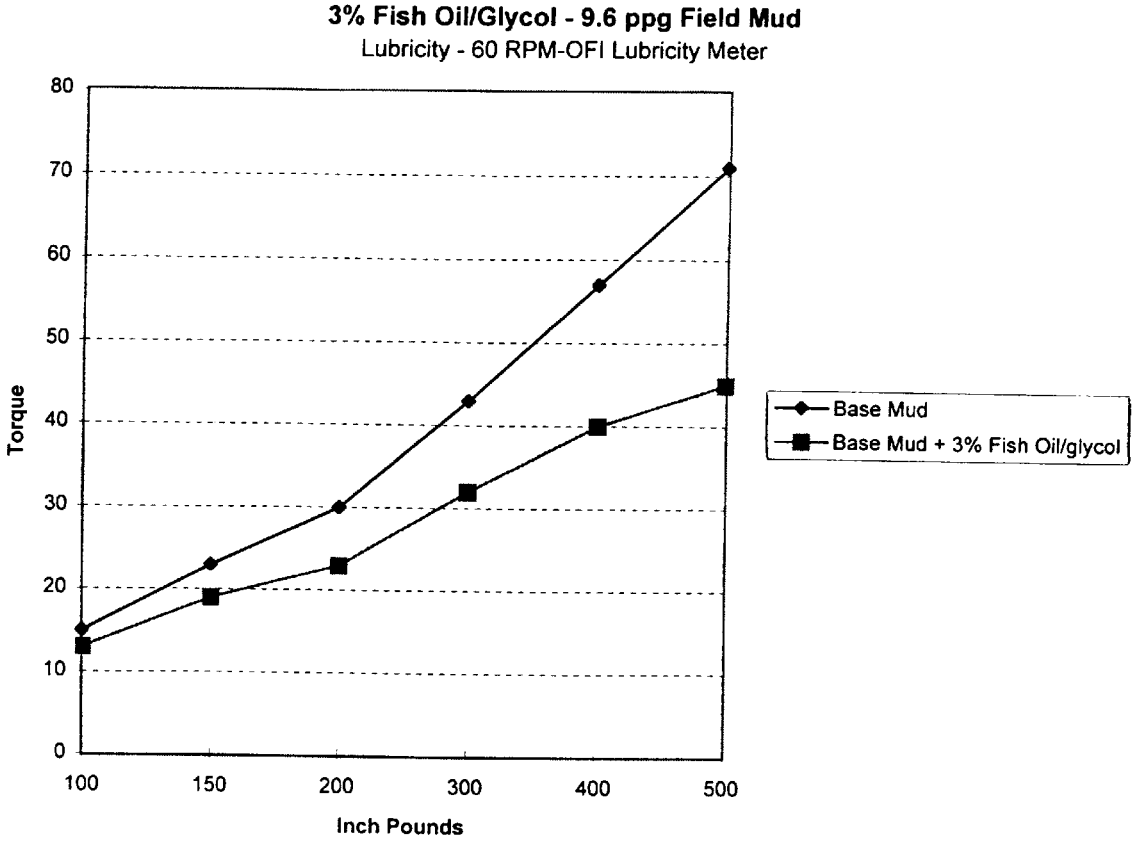
FIG. 1 is a graphical representation of a lubricity of a 9.6 ppg field mud in comparison with a 9.6 ppg field mud containing a 3% fish oil/glycol combination.

Reference will now be made in detail to the presently preferred embodiments of the invention.

The drilling fluid additive of the present invention comprises a mixture of a nonionic surfactant, an oil, an ester alcohol and a polypropylene glycol.

In one embodiment, the preferred nonionic surfactant for the drilling fluid additive is polyethoxylated glycol such as ether polyol-poly(oxyethylene-oxy) propylene glycol. The polyethoxylated glycol can also be selected from a group consisting of polybutylene glycol, polyethylene glycol, polypropylene glycol and mixtures thereof. In another embodiment, the preferred oil for the drilling fluid additive of the present invention is fish oil. The preferred fish oil is menhaden fish oil. The oil can also be selected from a group consisting of animal oil, mineral oil, vegetable oil, synthetic oil, and mixtures thereof. In still another embodiment, the ester alcohol is preferably 2,2,4 trimethyl-1,3 pentanediol monoisobutyrate. The ester alcohol can be an alcohol having the formula of $C_1$–$C_{16}$ with straight and/or branched chains.

In the present invention, the nonionic surfactant is from about 1% to about 90% of the drilling fluid mixture; the oil is from about 5% to about 90% of the drilling fluid mixture; the ester alcohol is from about 1% to about 50% of the drilling fluid mixture; and the polypropylene glycol is from about 1% to about 75% of the drilling fluid mixture. The amount of polypropylene glycol is dependent upon the amount of ester alcohol or surfactant or combination of the alcohol/surfactant. If the PPG is 10% of the mixture, there must be 10% of the surfactant or 10% of the alcohol or 10% of the combination of alcohol/surfactant. The preferred range for the polypropylene glycol is 1%–30% of the additive mixture. The preferred embodiment for the additive mixture would be 70% of the surfactant, 10% of the ester alcohol, 10% of the oil and 10% of the PPG.

The drilling fluid additive of the present invention can be utilized as a lubricant, a shale inhibitor, and/or a well bore stabilizing agent.

The present invention also provides a drilling fluid additive comprising a nonionic surfactant such as polyalkoxylated glycol. The polyethoxylated glycol is preferably ether polyol-poly(oxyethylene-oxy) propylene glycol. The polyethoxylated glycol can also be selected from a group consisting of polybutylene glycol, polyethylene glycol, polypropylene glycol and mixtures thereof. In another embodiment, the drilling fluid additive can comprise of a mixture of polyethoxylated glycol and polyproplyene glycol. In a further embodiment, the drilling fluid additive can be a mixture of polyethoxylated glycol and an oil. The oil is from about 1% to 99% of the drilling fluid additive and the surfactant is from about 1% to about 99% of the additive. The oil is preferably a refined fish oil, particularly menhaden fish oil. The oil can also be selected from a group consisting of animal oil, mineral oil, vegetable oil, synthetic oil, and mixtures thereof.

The present invention also provides a drilling fluid additive comprising an oil. In one embodiment, the additive can comprise an oil and an ester alcohol. The oil is from about 1% to about 99% of the drilling fluid additive and the alcohol can be from about 1% to about 99% of the additive. In another embodiment, the additive can comprise an oil, an ester alcohol and a surfactant.

In accordance with the present invention of manufacturing a water-based drilling fluid additive, an oil, an ester alcohol, a nonionic surfactant, and a polyproplyene glycol are admixed. In one embodiment, the oil and ester alcohol are mixed first and then a nonionic surfactant is admixed, and finally a polyproplyene glycol is admixed to form the additive. In a further embodiment, a nonionic surfactant and an oil are first mixed together. An ester alcohol is then added to the surfactant/oil mixture and then further agitated. Finally, polypropylene glycol is then added to the surfactant/oil/ester alcohol mixture and then further agitated to form the additive. The mixing step is conducted until the additive mixture is homogenous.

The above mixing procedures can be conducted with a high speed dispenser and shear pump such as a ROTOSTAT® 200XP-200, manufactured and sold by Admix, Inc. of Londonberry, N.H., U.S.A.

The present invention also provides a method of manufacturing a drilling fluid additive for use in drilling applications. The method comprises (a) mixing an ester alcohol and an oil; (b) adding a nonionic surfactant and agitating the mixture; and (c) adding a polyproplyene glycol to the mixture and further agitating the mixture.

The specific examples below will enable the present invention to be better understood. However, they are given merely by way of guidance and do not imply any limitations.

EXAMPLE 1

Improved Lubricity of the Drilling Fluid Additive-Fish Oil/Glycol

The following results in Tables 1 and 2 indicate the improvement in lubricating properties of 3% drilling fluid additive in two water based field muds verses the lubricity of the base muds themselves. The lubricity refers to the lubricity characteristics of the drilling fluid in contact with the drill string and bore hole walls. The drilling fluid lubricity was measured by the ability of the drilling fluid to reduce the coefficient of friction between two surfaces. The present invention reduced lubricity because it formed a film between the surfaces while minimizing wall cake build up. As illustrated in Tables 1 and 2, the torque readings in the drilling fluid additive treated mud are significantly lower than the untreated mud. In Table 1, the torque reading is done on a 9.6 ppg mud while in Table 2, the torque reading is done on a 17.7 ppg mud.

TABLE 1

IMPROVED LUBRICITY USING 3% DRILLING FLUID ADDITIVE IN WATER BASED FIELD MUDS ON AN OFI LUBRICITY METER @ 60 RPM
Torque Readings in a 9.6 ppg Mud - Also See FIG. 1

| Pressure in Inch/Pounds Applied | Base Mud | Base Mud + 3% Drilling Fluid Additive |
|---|---|---|
| 100 | 15 | 13 |
| 150 | 23 | 19 |
| 200 | 30 | 23 |
| 300 | 43 | 32 |
| 400 | 57 | 40 |
| 500 | 71 | 45 |
| 600 | Machine Stalled | 46 |

TABLE 2

Figure 2:
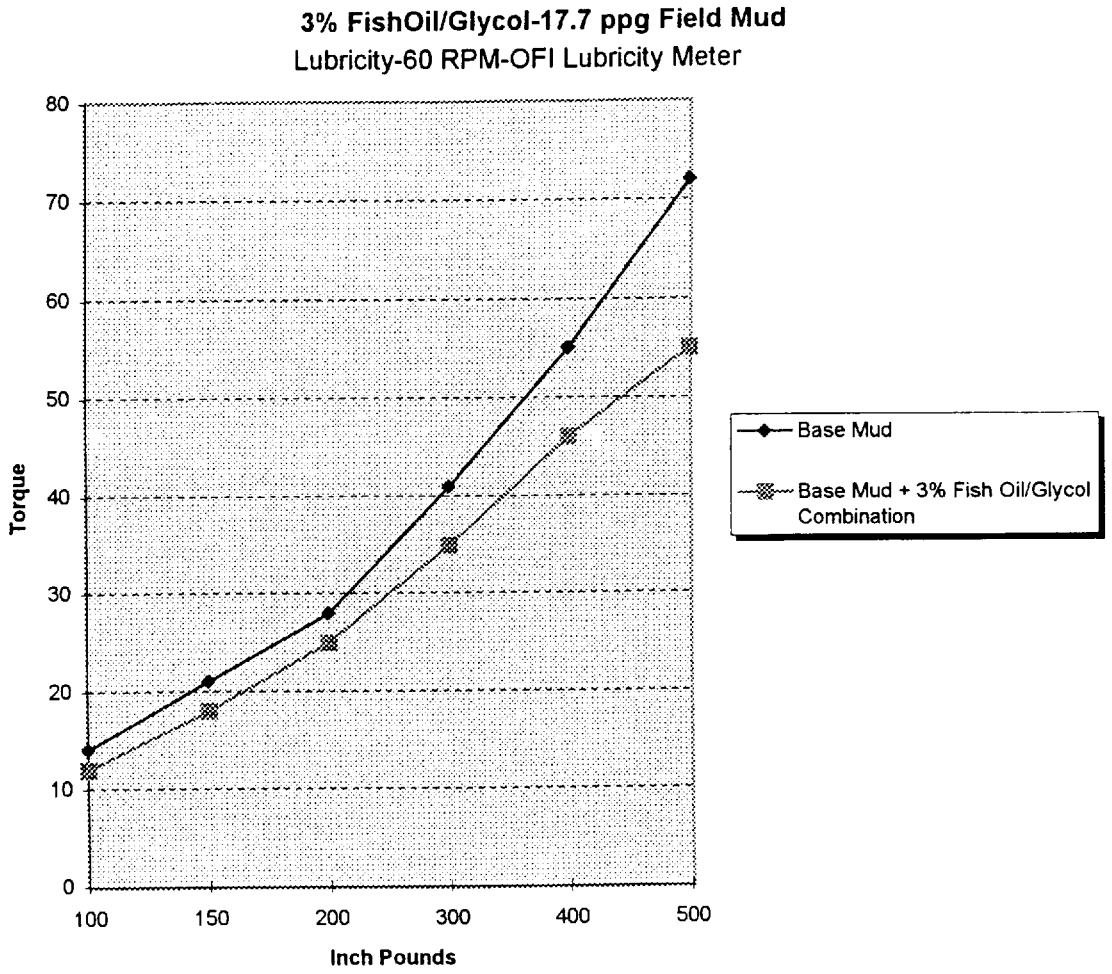
FIG. 2 is a graphical representation of a lubricity of a 17.7 ppg field mud in comparison with a 17.7 ppg field mud containing a 3% fish oil/glycol combination.

IMPROVED LUBRICITY USING 3% FISH OIL/GLYCOL IN WATER BASED FIELD MUDS ON AN OFI LUBRICITY METER
Torque Readings in a 17.7 ppg Mud - Also See FIG. 2

| Pressure in Inch/Pounds Applied | Base Mud | Base Mud + 3% Drilling Fluid Additive |
|---|---|---|
| 100 | 14 | 12 |
| 150 | 21 | 18 |
| 200 | 28 | 25 |
| 300 | 41 | 35 |
| 400 | 55 | 46 |
| 500 | 72 | 55 |
| 600 | Machine Stalled | 67 |

FIGS. 1 and 2 represent a linear graph presentation of Examples 1 and 2, respectively. As illustrated by FIGS. 1 and 2, the field mud with the 3% drilling fluid has improved lubricity in contrast to the mud without the. The torque readings in FIG. 1 were obtained on a 9.6 ppg field mud and the torque readings in FIG. 2 were obtained on a 17.7 ppg field mud.

EXAMPLE 2

Improved High Pressure and High Temperature Fluid Loss

Tables 3 & 4 demonstrate that the drilling fluid additive in water based field muds provide a lower high temperature/high pressure fluid loss producing less cc's of filtrate with a filter cake that is lighter in weight and thinner. The results of Table 3 were obtained using a 9.6 ppg field mud and the results of Table 4 were obtained using a 17.7 ppg field mud.

TABLE 3

30 MINUTE HIGH TEMPERATURE/HIGH PRESSURE FLUID LOSS @ 250° F.
9.6 ppg Mud

| | Base Mud | Base Mud + 3% Drilling Fluid Additive |
|---|---|---|
| Fluid Loss in cc | 29.0 | 26.8 |
| Filter Cake Weight in Grams | 15.7 | 13.4 |
| Filter Cake Thickness in Inches | 7/32" | 6/32" |

TABLE 4

30 MINUTE HIGH TEMPERATURE/HIGH PRESSURE FLUID LOSS @ 250° F.
17.7 ppg Mud

| | Base Mud | Base Mud + 3% Drilling Fluid Additive |
|---|---|---|
| Fluid Loss in cc | 24.0 | 11.0 |
| Filter Cake Weight in Grams | 77.3 | 48.0 |
| Filter Cake Thickness in Inches | 15/32" | 9/32" |

EXAMPLE 3

Shale Stability of the Drilling Fluid Additive

The ability of a product to reduce the swelling and disintegration of shale increases drilling rates and helps produce a "gauged hole". A shale sample from a drilling rig was placed into the base mud. Another sample of the same shale was placed in two additional samples of the base mud with 5% by volume of the fish oil/glycol combination. The shale samples were weighed before and after hot rolling the mud samples at 150° F. for 15 hours and the results recorded. Visual observations of each shale sample were also performed. The results of these shale studies are listed in Table 5.

TABLE 5

SHALE STABILITY TESTS AFTER HOT ROLLING @ 150° F. FOR 15 HOURS

| | Base Mud | Base Mud + 5% Fish Oil/Glycol |
|---|---|---|
| Shale Final Weight in Grams | 15.7 | 43.3 (Wt. Increase due to Mud) |
| Shale Initial Weight in Grams | 35.1 | 38.6 |
| Shale Weight Change in Grams | −19.4 | 4.7 |
| Percent Change in Weight | −55.3% | +12.2% |
| Shale Observations | 40% Remaining | 80% Remaining |

Obviously, numerous modifications and variations of the present the invention are possible in light of the above teachings. It is therefore to be understood that within the scope of the attendant claims appended hereto, the invention may be practiced otherwise than as specifically disclosed herein.

What is claimed is:

1. A drilling fluid additive comprising a mixture of a refined menhaden fish oil, an ester alcohol of a $C_1$–$C_{16}$ straight and/or branched chain alcohol, a polyether polyolpoly (oxyethylene-oxy) propylene glycol nonionic surfactant, and a polypropylene glycol.

2. The drilling fluid additive of claim 1 wherein the ester alcohol is 2,2,4 trimethyl-1,3 pentanediol monoisobutyrate.

3. The drilling fluid additive of claim 1 wherein the nonionic surfactant is from about 1% to about 90% of the mixture.

4. The drilling fluid additive of claim 1 wherein the oil is from about 5% to about 90% of the mixture.

5. The drilling fluid additive of claim 1 wherein the ester alcohol is from about 1% to about 50% of the mixture.

6. The drilling fluid additive of claim 1 wherein the polypropylene glycol is from about 1% to about 75% of the mixture.

7. The drilling fluid additive of claim 1 wherein the drilling fluid additive is utilized as a lubricant.

8. The drilling fluid additive of claim 1 wherein the drilling fluid additive is utilized as a shale inhibitor.

9. A method of manufacturing a drilling fluid additive for use in drilling applications, said method comprising the step of admixing a refined menhaden fish oil, an ester alcohol of a $C_1$–$C_{16}$ straight and/or branched alcohol, a polyether polyolpoly (oxyethylene-oxy) propylene glycol nonionic surfactant, and polypropylene glycol.

10. The method of claim 9 wherein the ester alcohol is 2,2,4 trimethyl-1, 3 pentanediol monoisobutyrate.

11. The method of claim 9 wherein the nonionic surfactant is from about 1% to about 90% of the mixture, the oil is from about 5% to about 90% of the mixture, the ester alcohol is from about 1% to about 50% of the mixture and the polypropylene glycol is from about 1% to about 75% of the mixture.

12. A method of manufacturing a drilling fluid additive for use in drilling applications, said method comprising the steps of:

a) mixing an ester alcohol of a $C_1$–$C_{16}$ straight and/or branched chain alcohol and a refined menhaden fish;

b) adding polyether polyol-poly (oxyethylene-oxy) propylene glycol nonionic surfactant to the mixture and agitating the mixture; and c) adding a polypropylene glycol to the mixture and further agitating the mixture.

13. The method of claim 12 wherein the mixing is conducted with a high speed dispenser and shear pump.

14. The method of claim 12 wherein the mixing step is conducted until the mixture is homogenous.

15. The method of claim 12 wherein the ester alcohol is 2,2,4 trimethyl-1, 3 pentanediol monoisobutyrate.

16. The method of claim 12 wherein the nonionic surfactant is from about 1% to about 90% of the mixture, the oil is from about 5% to about 90% of the mixture, the ester alcohol is from about 1% to about 50% of the mixture and the polypropylene glycol is from about 1% to about 75% of the mixture.

* * * * *